US008033124B2

(12) United States Patent
Han et al.

(10) Patent No.: US 8,033,124 B2
(45) Date of Patent: Oct. 11, 2011

(54) REFRIGERATOR AND DEFROST CONTROL METHOD THEREOF

(75) Inventors: Seong Joo Han, Yongin-si (KR); Young Shik Shin, Seongnam-si (KR); Jeong Su Han, Suwon-si (KR); Sung Hoon Kim, Suwon-si (KR); Su Ho Jo, Seongnam-si (KR); Hyen Young Choi, Suwon-si (KR); Sang Jun Lee, Suwon-si (KR); O Do Ryu, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 603 days.

(21) Appl. No.: 12/216,803

(22) Filed: Jul. 10, 2008

(65) Prior Publication Data

US 2009/0241561 A1 Oct. 1, 2009

(30) Foreign Application Priority Data

Mar. 28, 2008 (KR) ..... 10-2008-0028705

(51) Int. Cl.
*F25D 21/02* (2006.01)
*F25D 21/06* (2006.01)

(52) U.S. Cl. ..... 62/151; 62/153; 62/176.2; 62/234

(58) Field of Classification Search ..... 62/80, 131, 62/151, 153, 176.2, 234, 272, 275, 276
See application file for complete search history.

(56) References Cited

U.S. PATENT DOCUMENTS 5,666,816 A * 9/1997 Jeong et al. ..... 62/154

FOREIGN PATENT DOCUMENTS

JP 07260324 A * 10/1995
JP 07-294100 11/1995

* cited by examiner

*Primary Examiner* — Marc Norman
(74) *Attorney, Agent, or Firm* — Staas & Halsey LLP

(57) ABSTRACT

Disclosed herein are a refrigerator and a defrost control method thereof that are capable of sensing an amount of frost formed on an evaporator based on a change amount of absolute humidity in the refrigerator to control a defrost operation. A defrost control method of a refrigerator including a storage chamber and an evaporator to cool the storage chamber, includes sensing absolute humidity in the storage chamber, determining an estimated amount of frost formed on the evaporator using time segments in which the absolute humidity in the storage chamber decreases, and controlling a defrost operation based on the estimated amount of frost. According to the present embodiments, it is possible to perform the defrost operation at the point of time for optimum defrost, thereby maximizing energy efficiency and cooling efficiency.

25 Claims, 8 Drawing Sheets

REFRIGERATOR AND DEFROST CONTROL METHOD THEREOF

CROSS-REFERENCE TO RELATED APPLICATIONS

This application claims the benefit of Korean Patent Application No. 2008-0028705, filed on Mar. 28, 2008 in the Korean Intellectual Property Office, the disclosure of which is incorporated herein by reference.

BACKGROUND

1. Field

The present invention relates to a refrigerator and a defrost control method thereof, and, more particularly, to a refrigerator and a defrost control method thereof that are capable of sensing the amount of frost formed on an evaporator based on the change amount of absolute humidity in the refrigerator to control a defrost operation.

2. Description of the Related Art

Generally, a refrigerator is an apparatus that supplies cool air, generated when liquid refrigerant is evaporated to absorb the surrounding heat through a refrigeration cycle in which refrigerant circulates, to a food storage chamber, such as a freezing compartment and a refrigerating compartment, to keep various kinds of food fresh for a long time. The freezing compartment is normally maintained at a temperature of approximately −18° C., and the refrigerating compartment is normally maintained at a temperature of approximately 3° C.

The refrigeration cycle includes a compressor to compress refrigerant to a high temperature and high pressure, a condenser to condense the compressed refrigerant through heat exchange between the refrigerant and the surrounding air, a capillary tube to expand the condensed refrigerant to low pressure, and an evaporator to evaporate the expanded refrigerant through heat exchange between the refrigerant and food in the storage chamber. The surface temperature of the evaporator to cool the storage chamber through the refrigeration cycle is lower than the temperature of air in the storage chamber, with the result that moisture condensed from the air in the storage chamber, the temperature of which is relatively high, sticks to the surface of the evaporator, i.e., frost is formed on the evaporator. With the passage of time, the frost formed on the evaporator thickens, with the result that heat exchange efficiency of the refrigerant passing through the evaporator lowers, and therefore, power consumption increases excessively.

In a conventional refrigerator, the operation time of the compressor is integrated, and a defrost heater mounted adjacent to the evaporator is driven to perform a defrost operation, i.e., to defrost the evaporator, when an integrated operation time exceeds a predetermined time, in order to solve the above problem.

In the conventional refrigerator, however, the defrost operation is performed based on the integrated operation time of the compressor, irrespective of the amount of frost formed on the evaporator. As a result, it is difficult to efficiently defrost the evaporator. Also, cooling efficiency lowers due to unnecessary repetition of the defrost operation.

More specifically, moisture in the storage chamber evaporates with the passage of time in a fully sealed state in which a door of the refrigerator is closed, and frost is formed mostly on the evaporator. Consequently, when a large amount of external moisture is introduced into the storage chamber or a large amount of food is stored in the storage chamber, the amount of moisture in the storage chamber increases, with the result that the amount of frost formed on the evaporator increases. In the conventional refrigerator, however, the defrost operation is performed based on the predetermined integrated operation time of the compressor, irrespective of the amount of frost, which is varied depending upon the amount of moisture in the storage chamber. As a result, the defrost operation is not properly performed, and therefore, the frost formed on the evaporator is not fully removed, which lowers cooling efficiency of the refrigerator.

On the other hand, when the amount of moisture in the storage chamber is not large, the conventional refrigerator, which is constructed to perform the defrost operation for the predetermined integrated operation time of the compressor, although the defrost operation is not necessary when the amount of frost formed on the evaporator is small, unnecessarily frequently performs the defrost operation, with the result that power consumption increases excessively. Furthermore, high-temperature heat generated from the defrost heater is introduced into the storage chamber, with the result that cooling efficiency is lowered.

SUMMARY

Therefore, it is an aspect of the embodiments to provide a refrigerator and a defrost control method thereof that are capable of accurately sensing the amount of frost formed on an evaporator based on the change amount of absolute humidity in a storage chamber to perform a defrost operation at the point of time for optimum defrost.

It is another aspect of the embodiments to provide a refrigerator and a defrost control method thereof that are capable of deciding a defrost operation end time as well as a defrost operation start time based on the amount of frost formed on the evaporator.

Additional aspects and/or advantages will be set forth in part in the description which follows and, in part, will be apparent from the description, or may be learned by practice of the invention.

The foregoing and/or other aspects are achieved by providing a defrost control method of a refrigerator including a storage chamber and an evaporator to cool the storage chamber, including sensing absolute humidity in the storage chamber, determining an estimated amount of frost formed on the evaporator using time segments in which the absolute humidity in the storage chamber decreases, and controlling a defrost operation based on the estimated amount of frost.

The sensing absolute humidity in the storage chamber may include sensing absolute humidity in the storage chamber in a predetermined cycle.

The estimated amount of frost may be determined using an integrated value of change amounts of absolute humidity only at the time segments where the absolute humidity in the storage chamber decreases.

$$\text{Amount of frost} = \sum_{k} F(AH_k - AH_{k-1})$$

where A is a coefficient selected based on the internal capacity of the storage chamber, and k is a constant.

The determining the estimated amount of frost may include reading a value of an amount of frost corresponding to the integrated value of the change amounts of absolute humidity from a memory to determine the estimated amount of frost.

The determining the estimated amount of frost may include calculating the amount of frost corresponding to the integrated value of the change amounts of absolute humidity by the following equation to determined the estimated amount of frost.

$$\text{Amount of frost} = \sum_{k} F(AH_k - AH_{k-1})$$

where A is a coefficient selected based on the internal capacity of the storage chamber, and k is a constant.

The controlling the defrost operation may include deciding an operation time of a defrost heater to defrost the evaporator based on the determined estimated amount of frost to perform the defrost operation.

The controlling the defrost operation may include reading a value of an output and operation time of a defrost heater based on the determined estimated amount of frost from a memory to decide the output and operation time of the defrost heater to perform the defrost operation.

The foregoing and/or other aspects are achieved by providing a defrost control method for a refrigerator including a storage chamber, an evaporator to cool the storage chamber, and a door to open and close the storage chamber, including sensing opening and closing of the door, sensing absolute humidity in the storage chamber immediately before and after the opening and closing of the door, determining an estimated amount of frost formed on the evaporator using the sensed absolute humidity, and controlling a defrost operation based on the estimated amount of frost.

The determining the estimated amount of frost may include determining a change amount of absolute humidity at an opening of the door after a closing of the door from the absolute humidity at the closing of the door and determining the estimated amount of frost formed on the evaporator using an integrated value of change amounts of absolute humidity.

The determining the estimated amount of frost may include reading an amount of frost corresponding to an integrated value of change amounts of absolute humidity from a memory, or calculating an amount of frost corresponding to the integrated value of the change amounts of absolute humidity, to determine the estimated amount of frost.

The foregoing and/or other aspects are achieved by providing a refrigerator including a storage chamber, an evaporator to cool the storage chamber, a humidity sensor sensing absolute humidity in the storage chamber, and a controller determining an estimated amount of frost formed on the evaporator using time segments in which the absolute humidity in the storage chamber decreases and controlling a defrost operation based on the estimated amount of frost.

The humidity sensor may sense absolute humidity in the storage chamber in a predetermined cycle.

The controller may determine the estimated amount of frost using an integrated value of change amounts of absolute humidity only at the time segments where the absolute humidity in the storage chamber decreases.

The refrigerator may further include a memory storing an amount of frost corresponding to the integrated value of the change amounts of absolute humidity, the controller reading the amount of frost corresponding to the integrated value of the change amounts of absolute humidity from the memory to determine the estimated amount of frost.

The refrigerator may further include a defrost heater to defrost the evaporator, the controller deciding an operation time of the defrost heater based on the estimated amount of frost formed on the evaporator to perform the defrost operation.

The refrigerator may further include a defrost heater to defrost the evaporator and a memory storing an output and operation time of the defrost heater based on the amount of frost, the controller reading the output and operation time of the defrost heater based on the estimated amount of frost from the memory to perform the defrost operation.

The foregoing and/or other aspects are achieved by providing a refrigerator including a storage chamber, an evaporator to cool the storage chamber, a humidity sensor sensing absolute humidity in the storage chamber, a door opening and closing the storage chamber, a door opening and closing sensor sensing the opening and closing of the door, and a controller sensing absolute humidity in the storage chamber immediately before and after the opening and closing of the door, determining an estimated amount of frost formed on the evaporator using the sensed absolute humidity, and controlling a defrost operation based on the estimated amount of frost.

The controller may determine a change amount of absolute humidity at the opening of the door after the closing of the door from the absolute humidity at the closing of the door and may determine the estimated amount of frost formed on the evaporator using an integrated value of change amounts of absolute humidity.

The foregoing and/or other aspects are achieved by providing a defrost control method for a refrigerator having a storage chamber, a door opening and closing the storage chamber, and an evaporator, including: sensing absolute humidity in the storage chamber; calculating a change amount of absolute humidity over time; and integrating a reduction of the calculated change amount of absolute humidity over time to estimate an amount of frost formed on the evaporator.

The foregoing and/or other aspects are achieved by providing a defrost control method for a refrigerator having a storage chamber, a door opening and closing the storage chamber, and an evaporator, including: sensing a first absolute humidity in the storage chamber after the door is closed; sensing a second absolute humidity in the storage chamber after the door is opened, following the door being closed; calculating a change amount of absolute humidity from the first and second absolute humidities; calculating an estimated amount of frost from the calculated change amount of absolute humidity; and determining whether to perform a defrost operation based on the estimated amount of frost.

The determining whether to perform the defrost operation may include comparing the estimated amount of frost with a predetermined reference amount, and determining to perform the defrost operation when the estimated amount of frost is greater than the predetermined reference amount and determining not to perform the defrost operation when the estimated amount of frost is not greater than the predetermined reference amount.

BRIEF DESCRIPTION OF THE DRAWINGS

These and/or other aspects and advantages will become apparent and more readily appreciated from the following description of the embodiments, taken in conjunction with the accompanying drawings, of which.

DETAILED DESCRIPTION OF EMBODIMENTS

Figure 1:
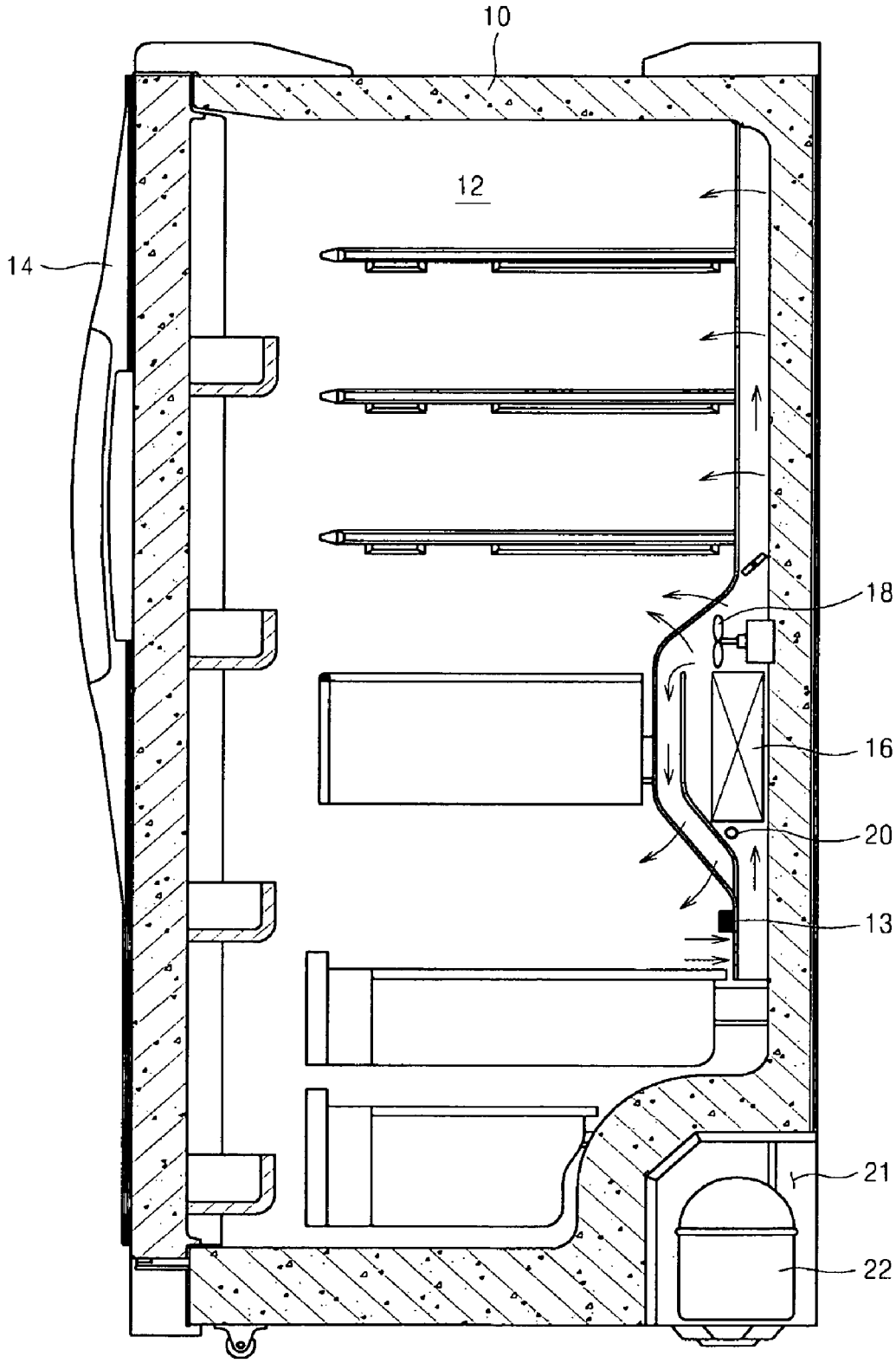
FIG. 1 is a sectional view illustrating a refrigerator according to a first embodiment.

Reference will now be made in detail to the embodiments, examples of which are illustrated in the accompanying drawings, wherein like reference numerals refer to like elements throughout. The embodiments are described below to explain the present invention by referring to the figures.

FIG. 1 is a sectional view illustrating a refrigerator according to a first embodiment.

Referring to FIG. 1, the refrigerator includes a refrigerator body 10 open at the front thereof, a storage chamber 12 defined in the refrigerator body 10 to store food, and a door 14 hingedly coupled to one side end of refrigerator body 10 to open and close the storage chamber 12.

At a lower rear of the storage chamber 12 is mounted a humidity sensor 13 to sense absolute humidity in the storage chamber 12.

Outside the rear of the storage chamber 12 is mounted an evaporator 16 to cool the storage chamber 12. Above the evaporator 16 is mounted a fan 18 to circulate cool air into the storage chamber 12. Below the evaporator 16 is mounted a defrost heater 20 to defrost the evaporator 16.

Also, a machinery compartment 21, as a separate space, is provided at the lower rear of the refrigerator body 10. In the machinery compartment 21 is mounted a compressor 22.

Figure 2:
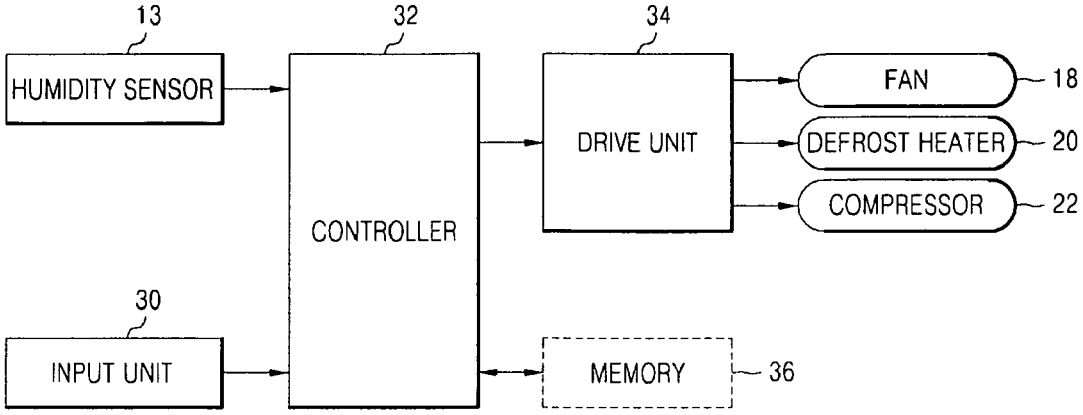
FIG. 2 is a defrost control block diagram of the refrigerator according to the first embodiment.

FIG. 2 is a defrost control block diagram of the refrigerator according to the first embodiment. The refrigerator includes a humidity sensor 13, an input unit 30, a controller 32, a drive unit 34, and a memory 36.

The input unit 30 allows a user to input a control command to the controller 32. The input unit 30 may include a plurality of buttons, such as a start button to start the temperature control of food, a temperature set button to set temperature required to store the food, etc. The input unit 30 may additionally or alternatively include any type of input mechanism that allows a user to input a control command, including but not limited to a touch screen, for example.

The controller 32 is a microprocessor to control an overall operation of the refrigerator. The controller 32 receives absolute humidity in the storage chamber 12 sensed by the humidity sensor 13 in a predetermined cycle to calculate a change amount of absolute humidity, integrates a reduction of the calculated change amount of absolute humidity, i.e., the decrease amount of absolute humidity, to estimate the amount of frost formed on the evaporator 16, and decides a defrost operation start time based on the estimated amount of frost.

While the door 14 is closed, moisture in the storage chamber 12 evaporates with the passage of time, and frost is formed mostly on the evaporator 16, with the result that the moisture in the storage chamber 12 decreases. Consequently, it is possible to estimate the amount of frost formed on the evaporator 16 using the decrease amount of the moisture.

Also, the controller 32 decides a defrost operation end time based on the estimated amount of frost, and, at the same time, the output and operation time of the defrost heater to optimally achieve the defrost operation.

The drive unit 34 drives the compressor 22, the fan 18, and the defrost heater 20 according to a drive control signal of the controller 32.

The memory 36 stores estimated values of the amount of frost corresponding to the decrease amount of absolute humidity integrated by the controller 32. The memory 36 may also store control factors of the defrost operation end time corresponding to the amount of frost formed on the evaporator, i.e., the output and operation time of the defrost heater 20.

The memory 36 is not necessarily provided. For example, it is possible to directly calculate the amount of frost through a calculation equation using an integrated value of the decrease amounts of absolute humidity. Alternatively, it is possible for the controller 32 to set the output and operation time of the defrost heater to be a fixed value to control the output and operation time of the defrost heater.

Hereinafter, the operation of the refrigerator with the above-stated construction and a defrost control method of the refrigerator will be described with reference to FIGS. 3 and 4.

Figure 3:
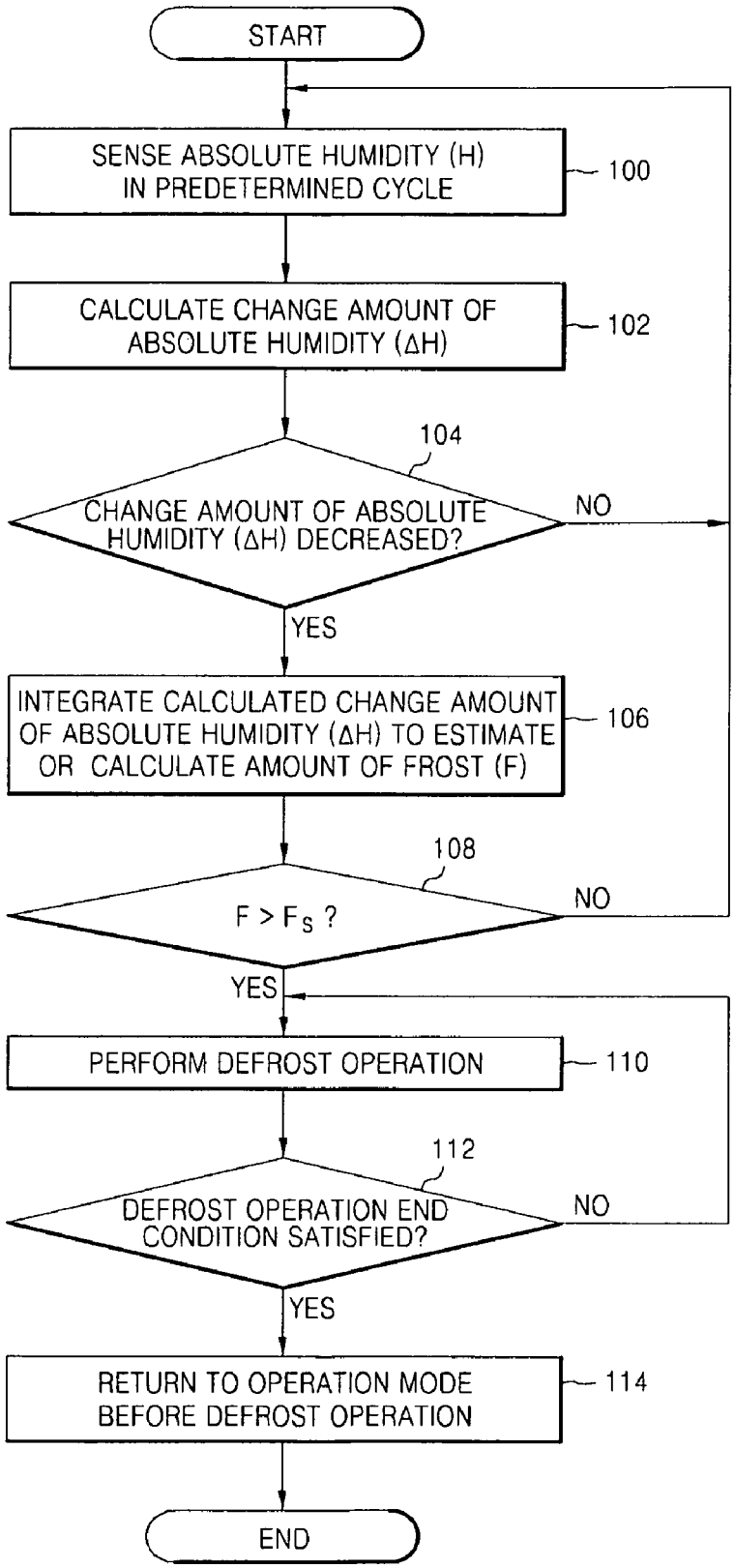
FIG. 3 is a flow chart illustrating a method of controlling a defrost operation of the refrigerator according to the first embodiment.
Figure 4:
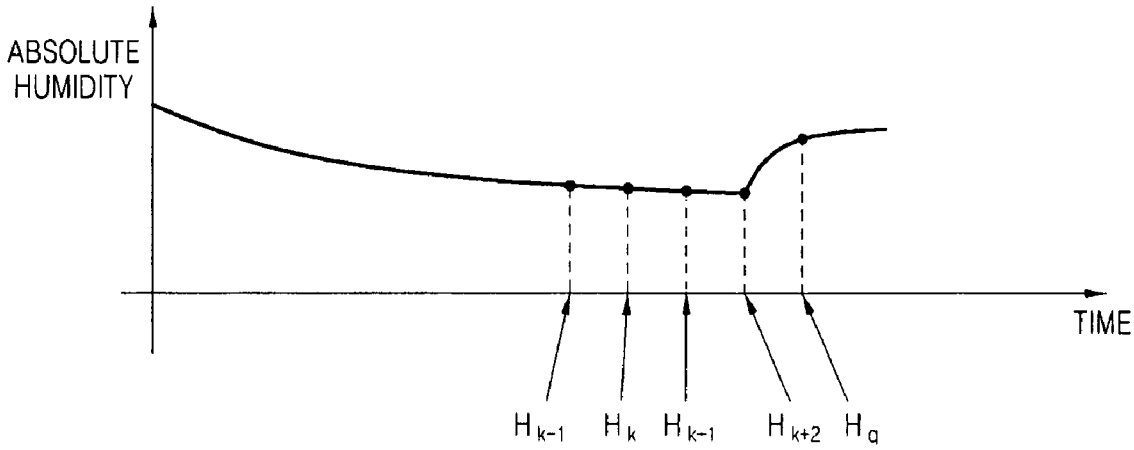
FIG. 4 is a graph illustrating a change amount of absolute humidity based on time of the refrigerator according to the first embodiment.

FIG. 3 is a flow chart illustrating a method of controlling a defrost operation of the refrigerator according to the first embodiment, and FIG. 4 is a graph illustrating a change amount of absolute humidity based on time of the refrigerator according to the first embodiment.

First, when a user puts food to be stored in the storage chamber 12, presses the temperature set button of the input unit 30 to set temperature, and presses the start button, cool air generated by a normal refrigeration cycle is supplied into the storage chamber 12 to lower an interior temperature of the storage chamber 12.

In a fully sealed state in which the door 14 is closed, moisture in the storage chamber 12 evaporates with the passage of time, and frost is formed mostly on the evaporator 16, with the result that the moisture in the storage chamber 12 decreases, as shown in FIG. 4.

At this time, absolute humidity H in the storage chamber 12 is sensed by the humidity sensor 13 in a predetermined cycle, and the sensed absolute humidity is inputted to the controller 32 (100).

The controller 32 calculates a change amount of absolute humidity ΔH from the absolute humidity H in the storage chamber 12 sensed periodically (102) and determines whether the calculated change amount of absolute humidity ΔH has decreased (104), if the change amount of absolute humidity ΔH has decreased. If the change amount of absolute humidity ΔH has not decreased, the process returns to operation 100 to again sense the absolute humidity H in a predetermined cycle.

The controller 32 integrates the decrease amount of sections, or time segments, where the humidity decreases, such as $H_{k-1} \rightarrow H_k \rightarrow H_{k+1} \rightarrow H_{k+2}$ of FIG. 4, i.e., the decrease amount of absolute humidity, and reads an estimated value of the amount of frost F corresponding to the integrated decrease amount of absolute humidity from the memory to estimate the amount of frost F on the evaporator 16 (106).

Alternatively, as previously mentioned, the controller 32 may directly calculate the amount of frost as follows:

$$\text{Amount of frost} = \sum_k F(AH_k - AH_{k-1})$$

Where A is a coefficient selected based on an internal capacity of the storage chamber 12, and k is a constant.

As can be seen from FIG. 4, moisture in the storage chamber 12 evaporates with the passage of time while the door 14 is closed, and frost is formed mostly on the evaporator 16, with the result that humidity in the storage chamber 12 decreases. Consequently, when the decrease amount of humidity is converted into the amount of frost, it is possible to correctly estimate the amount of frost formed on the evaporator 16. The controller 32 decides a defrost operation start time based on such information.

At this time, the controller 32 does not include the change amount of the section where humidity increases, such as $H_{k+2} \rightarrow H_q$ of FIG. 4, in the integration. This is because the amount of frost formed on the evaporator 16 is the decrease amount of absolute humidity caused by the evaporation of moisture in the storage chamber 12, and therefore, the change amount of the section where humidity increases is not formed on the evaporator 16.

Subsequently, the controller 32 compares the estimated amount of frost F with a predetermined reference amount Fs (108). When the amount of frost F is not greater than the reference amount Fs, the procedure feedbacks to operation 100, where the controller 32 calculates the change amount of absolute humidity ΔH in the storage chamber 12, and performs the following operations.

When the amount of frost F is greater than the reference amount Fs as a result of the comparison at operation 108, the controller 32 determines that the amount of frost formed on the evaporator 16 is large, and therefore, a defrost operation is to be started to remove the frost from the evaporator 16, and controls the defrost heater 20 to perform the defrost operation (110).

Subsequently, the controller 32 determines whether a defrost operation end condition is satisfied (112). When the defrost operation end condition is satisfied, the controller 32 controls the refrigerator to return to an operation mode before the defrost operation (114), and ends the defrost operation.

The defrost operation end condition is a condition necessary to fully remove frost formed on the evaporator 16 according to the operation of the defrost heater 20. For example, a defrost heater operating time for the defrost operation is previously established by the controller 32, and, when the established time elapses, the controller 32 determines that the defrost operation end condition is satisfied. Alternatively, the controller 32 may read control factors of the defrost operation end time corresponding to the amount of frost, stored in the memory 36, i.e., the output and operation time of the defrost heater 20, to establish the defrost operation end condition. Other well-known defrost operation end determination methods, including a method of sensing defrost water and a method of sensing the change in water level of defrost water, may also be used.

The method of estimating the amount of frost formed on the evaporator 16 according to the change amount of absolute humidity in the storage chamber 12 based on time to perform the defrost operation was described. Hereinafter, a method of estimating the amount of frost formed on the evaporator 16 according to the change amount of absolute humidity in the storage chamber 12 based on door opening and closing to perform a defrost operation will be described with reference to FIGS. 5 to 8.

Figure 5:
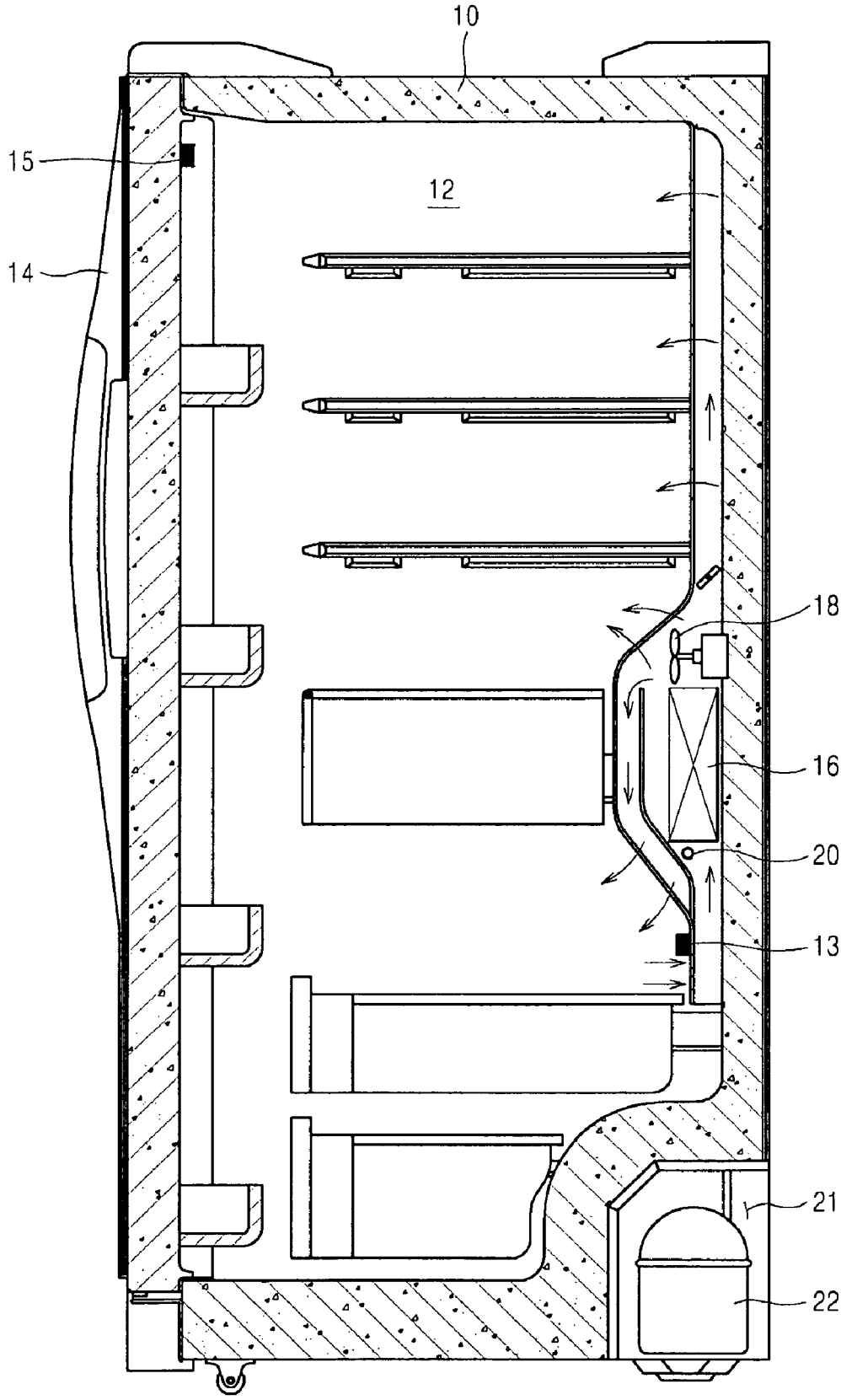
FIG. 5 is a sectional view illustrating a refrigerator according to a second embodiment.

FIG. 5 is a sectional view illustrating a refrigerator according to a second embodiment. Parts of FIG. 5 identical to those of FIG. 1 are denoted by the same numerals and the same titles, and a detailed description thereof will not be given.

Referring to FIG. 5, a door opening and closing sensor 15 is mounted at the upper front of the storage chamber 12, i.e., at a position where the storage chamber 12 comes into contact with the door 14, to sense the opening and closing of the door 14.

Figure 6:
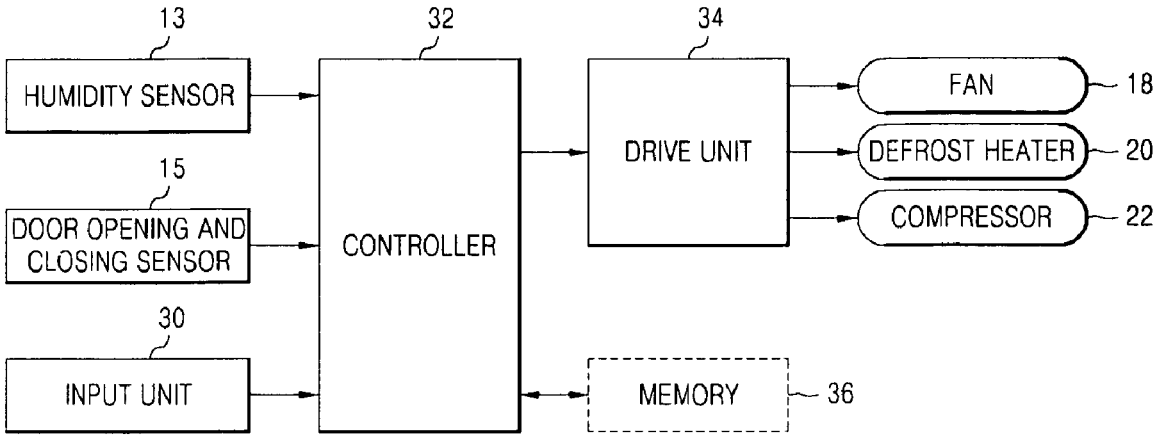
FIG. 6 is a defrost control block diagram of the refrigerator according to the second embodiment.

FIG. 6 is a defrost control block diagram of the refrigerator according to the second embodiment of the present invention. The refrigerator includes a humidity sensor 13, a door opening and closing sensor 15, an input unit 30, a controller 32, a drive unit 34, and a memory 36. Parts of FIG. 6 identical to those of FIG. 2 are denoted by the same numerals and the same titles, and a detailed description thereof will not be given.

Referring to FIG. 6, the controller 32 calculates the change amount of absolute humidity at the time of opening and closing the door 14 to estimate the amount of frost formed on the evaporator 16 such that sensing cycles of the change amount of absolute humidity are controlled to be variable.

This calculation more accurately calculates the change amount of absolute humidity at longer sensing cycles by irregularly sensing the value of absolute humidity immediately before and after the opening and closing of the door 14 using the fact that the change of moisture in the storage chamber 12 is not high while the door 14 is closed, but the change of moisture in the storage chamber 12 is high, comparative to the change of moisture while the door 14 is closed, at the time of opening and closing the door 14, at which external moisture is introduced into the storage chamber 12.

Figure 7:
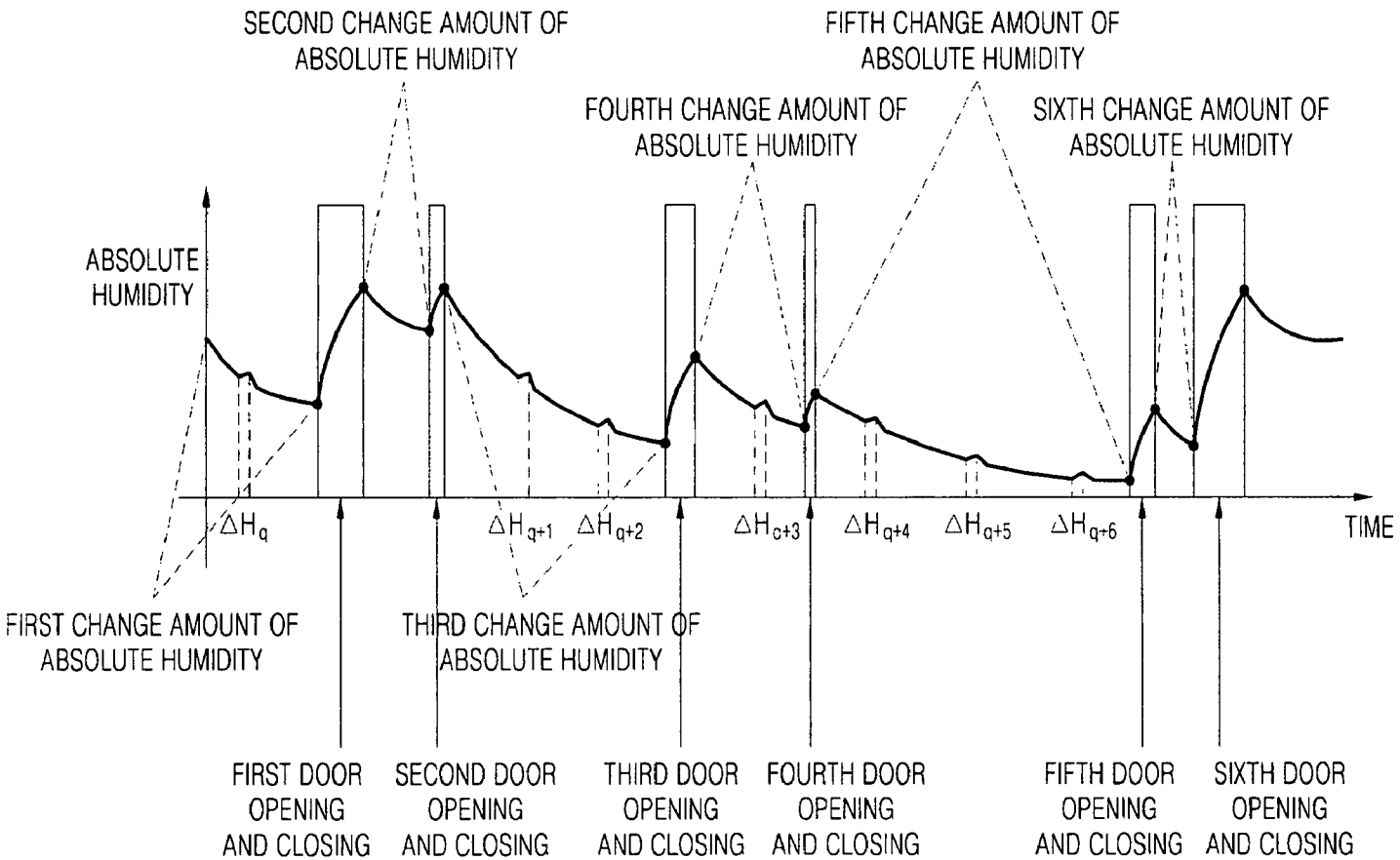
FIG. 7 is a graph illustrating a change amount of absolute humidity based on door opening and closing of the refrigerator according to the second embodiment.

FIG. 7 is a graph illustrating the change amount of absolute humidity based on door opening and closing of the refrigerator according to the second embodiment.

Referring to FIG. 7, sections where the increase amount of absolute humidity is low, e.g., for example, $\Delta H_q$, $\Delta H_{q+1}$, $\Delta H_{q+2}$ . . . , indicate states in which external moisture is not introduced into the storage chamber 12, i.e., moisture is generated from food in the storage chamber 12 while the door 14 is closed, and sections where the increase amount of absolute humidity is high, comparative to the increase amount of absolute humidity, e.g., the first door opening and closing, the second door opening and closing, the third door opening and closing . . . , indicate states in which a large amount of external moisture is introduced into the storage chamber 12 by opening and closing the door 14.

As can be seen from FIG. 7, the change of moisture in the storage chamber 12 is not high while the door 14 is closed, but the change of moisture in the storage chamber 12 is high, comparatively, at the time of opening and closing the door 14, at which external moisture is introduced into the storage chamber 12. While the door 14 is closed, moisture generally decreases, and the increased degree of moisture due to food in the storage chamber 12 or other conditions is insignificant. Consequently, the above-described change of moisture may be included in an error range of the humidity sensor 13. In recent years, the amount of moisture generated from food has further decreased by virtue of high sealability of containers to store food. Consequently, when values of absolute humidity, i.e., the first change amount of absolute humidity, the second change amount of absolute humidity, the third change amount of absolute humidity . . . , immediately before and after the opening and closing of the door 14 are sensed irregularly, it is possible to considerably reduce the sensing operation of the humidity sensor 13 in the calculating operation of the controller 32, although the accuracy slightly lowers as compared to when humidity in the storage chamber 12 is sensed at predetermined cycles as shown in FIG. 4, thereby improving the durability thereof.

Also, it is possible to reduce the operation load of the controller 32, and therefore, it is possible to use a lower-level microprocessor. In addition, it is possible to implement other functions using a reserve load of the microprocessor.

Figure 8:
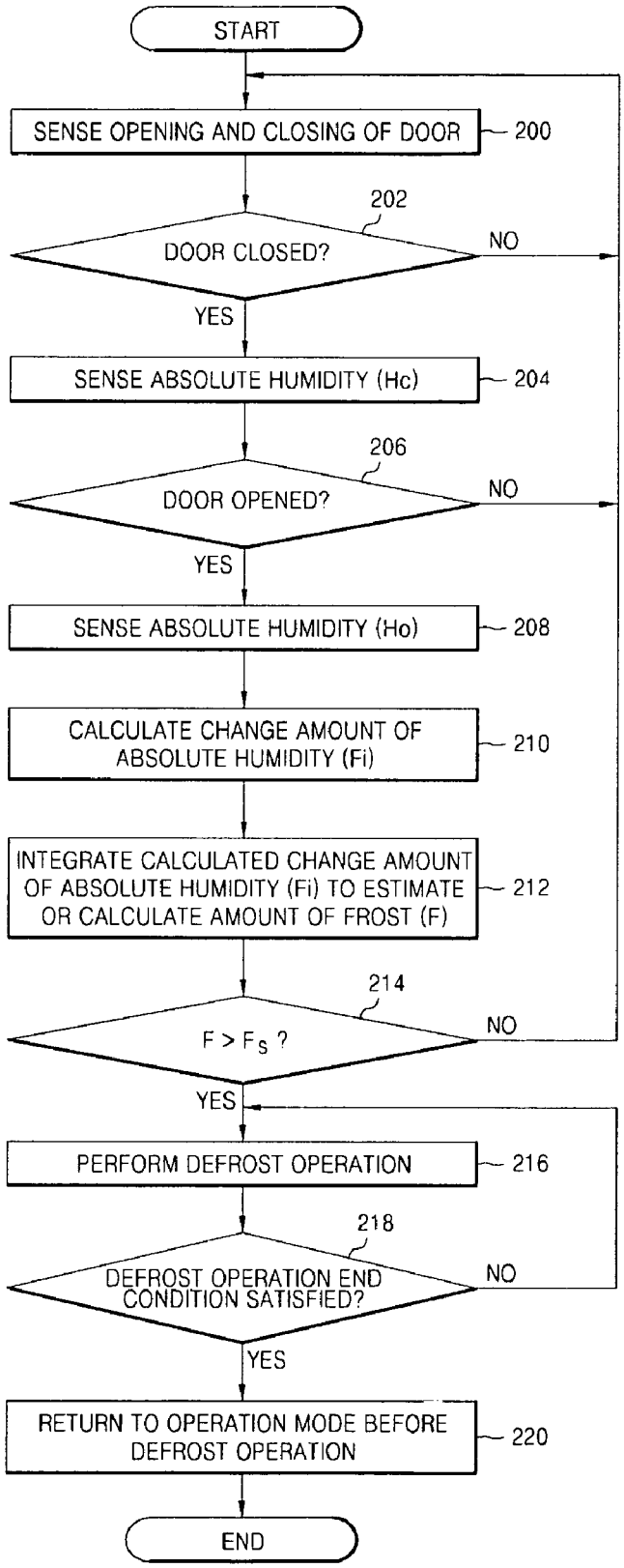
FIG. 8 is a flow chart illustrating a method of controlling a defrost operation of the refrigerator according to the second embodiment.

FIG. 8 is a flow chart illustrating a method of controlling a defrost operation of the refrigerator according to the second embodiment. A description of parts of FIG. 8 identical to those of FIG. 3 will be maximally omitted.

First, the opening and closing of the door 14 is sensed by the door opening and closing sensor 15 and is inputted to the controller 32 (200).

When the opening and closing of the door 14 is sensed, the controller 32 determines whether the closing of the door 14 is sensed (202). When the closing of the door 14 is sensed, absolute humidity Hc in the storage chamber 12 immediately after the closing of the door 14 is sensed by the humidity sensor 13 (204).

Subsequently, the controller 43 determines whether the opening of the door 14 is sensed (206). When the opening of the door 14 is sensed, absolute humidity Ho in the storage chamber 12 immediately after the opening of the door 14 is sensed by the humidity sensor 13 (208).

Then, the change amount of absolute humidity (Fi=Hc−Ho) is calculated from the absolute humidities Hc and Ho in the storage chamber 12 sensed immediately before and after the opening and closing of the door 14 (210).

Subsequently, the controller 32 senses irregularity and integrates the change amounts of absolute humidity immediately before and after the opening and closing of the door 14, such as the first change amount of absolute humidity, the second change amount of absolute humidity, the third change amount of absolute humidity, etc. of FIG. 7, i.e., the decrease amounts of absolute humidity, and reads an estimated value of the amount of frost F corresponding to the integrated decrease amount of absolute humidity from the memory to estimate the amount of frost F on the evaporator 16 (212).

Alternatively, as previously mentioned, the controller 32 may directly calculate the amount of frost as follows:

$$\text{Amount of frost}(F)=\Sigma Fi$$

Subsequently, the controller 32 compares the estimated amount of frost F with a predetermined reference amount Fs (214). When the amount of frost F is not greater than the reference amount Fs, the procedure feedbacks to operation 200, where the controller 32 again calculates the change amount of absolute humidity Fi in the storage chamber 12 at the time of opening and closing the door 14, and performs the following operations.

When the amount of frost F is greater than the reference amount Fs as a result of the comparison at operation 214, the controller 32 determines that the amount of frost formed on the evaporator 16 is large, and therefore, a defrost operation is to be started to remove the frost from the evaporator 16, and the controller 32 controls the defrost heater 20 to perform the defrost operation (216).

Subsequently, the controller 32 determines whether a defrost operation end condition is satisfied (218). When the defrost operation end condition is satisfied, the controller 32 controls the refrigerator to return to an operation mode before the defrost operation (220), and ends the defrost operation.

In the above embodiments, the refrigerator was described as an example. However, the present embodiments are not limited to the refrigerator but are applicable to any electric home appliance, such as an air conditioner, using the evaporator 16.

As apparent from the above description, the refrigerator and the defrost control method thereof according to the present embodiments are capable of accurately sensing the amount of frost formed on the evaporator based on the change amount of absolute humidity in the storage chamber to estimate the amount of frost which may be changed depending upon the amount of moisture in the storage chamber, thereby performing the defrost operation at the point of time for optimum defrost. Also, the refrigerator and the defrost control method thereof according to the present embodiments are capable of deciding the defrost operation end time as well as the defrost operation start time based on the amount of frost formed on the evaporator. Consequently, the present embodiments have the effect of maximizing energy efficiency and cooling efficiency.

Furthermore, the refrigerator and the defrost control method thereof according to the present embodiments are capable of memorizing the defrost operation conditions to decide the output and operation time of the defrost heater based on the amount of frost. Consequently, the present embodiments have the effect of more efficiently performing the defrost operation.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A defrost control method for a refrigerator including a storage chamber and an evaporator to cool the storage chamber, comprising:

sensing absolute humidity in the storage chamber;

determining an estimated amount of frost formed on the evaporator using time segments in which the absolute humidity in the storage chamber decreases; and controlling a defrost operation based on the estimated amount of frost, wherein the estimated amount of frost is determined by integrating change amounts of absolute humidity according to the time segments.

2. The defrost control method according to claim 1, wherein the sensing absolute humidity in the storage chamber includes sensing absolute humidity in the storage chamber in a predetermined cycle.

3. The defrost control method according to claim 1, wherein the estimated amount of frost is determined using an integrated value of change amounts of absolute humidity only at the time segments where the absolute humidity in the storage chamber decreases.

4. The defrost control method according to claim 3, wherein the determining the estimated amount of frost includes reading a value of an amount of frost corresponding to the integrated value of the change amounts of absolute humidity from a memory to determine the estimated amount of frost.

5. The defrost control method according to claim 3, wherein the determining the estimated amount of frost includes calculating the amount of frost corresponding to the integrated value of the change amounts of absolute humidity by the following equation to determine the estimated amount of frost:

$$\text{Amount of frost} = \sum_{k} F(AH_k - AH_{k-1})$$

where A is a coefficient selected based on the internal capacity of the storage chamber, and k is a constant.

6. The defrost control method according to claim 1, wherein the controlling the defrost operation includes deciding an operation time of a defrost heater to defrost frost formed on the evaporator based on the determined estimated amount of frost to perform the defrost operation.

7. The defrost control method according to claim 1, wherein the controlling the defrost operation includes reading a value of an output and operation time of a defrost heater based on the determined estimated amount of frost from a memory to decide the output and operation time of the defrost heater to perform the defrost operation.

8. A defrost control method for a refrigerator including a storage chamber, an evaporator to cool the storage chamber, and a door to open and close the storage chamber, comprising:

sensing opening and closing of the door;

sensing absolute humidity in the storage chamber immediately before and after the opening and closing of the door;

determining an estimated amount of frost formed on the evaporator using the sensed absolute humidity; and controlling a defrost operation based on the estimated amount of frost.

9. The defrost control method according to claim 8, wherein the determining the estimated amount of frost includes determining a change amount of absolute humidity at an opening the door after a closing of the door from the absolute humidity at the closing of the door and determining the estimated amount of frost formed on the evaporator using an integrated value of change amounts of absolute humidity.

10. The defrost control method according to claim 8, wherein the determining the estimated amount of frost includes reading an amount of frost corresponding to an integrated value of change amounts of absolute humidity from a memory, or calculating an amount of frost corresponding to the integrated value of the change amounts of absolute humidity, to determine the estimated amount of frost.

11. The defrost control method according to claim 8, wherein the controlling the defrost operation includes deciding an operation time of a defrost heater to defrost the evaporator based on the estimated amount of frost to perform the defrost operation.

12. The defrost control method according to claim 8, wherein the controlling the defrost operation includes reading a value of an output and operation time of a defrost heater based on the estimated amount of frost from a memory to decide the output and the operation time of the defrost heater to perform the defrost operation.

13. A refrigerator comprising:

a storage chamber;

an evaporator to cool the storage chamber;

a humidity sensor sensing absolute humidity in the storage chamber; and a controller determining an estimated amount of frost formed on the evaporator using time segments in which the absolute humidity in the storage chamber decreases and controlling a defrost operation based on the estimated amount of frost, wherein the controller determines the estimated amount of frost by integrating change amounts of absolute humidity according to the time segments.

14. The refrigerator according to claim 13, wherein the humidity sensor senses absolute humidity in the storage chamber in a predetermined cycle.

15. The refrigerator according to claim 13, wherein the controller determines the estimated amount of frost using an integrated value of change amounts of absolute humidity only at the time segments where the absolute humidity in the storage chamber decreases.

16. The refrigerator according to claim 15, further comprising:

a memory storing an amount of frost corresponding to the integrated value of the change amounts of absolute humidity, the controller reading the amount of frost corresponding to the integrated value of the change amounts of absolute humidity from the memory to determine the estimated amount of frost.

17. The refrigerator according to claim 15, wherein the controller calculates the amount of frost corresponding to the integrated value of the change amounts of absolute humidity by the following equation to determine the estimated amount of frost:

$$\text{Amount of frost} = \sum_{k} F(AH_k - AH_{k-1})$$

where A is a coefficient selected based on the internal capacity of the storage chamber, and k is a constant.

18. The refrigerator according to claim 13, further comprising:

a defrost heater to defrost the evaporator, the controller deciding an operation time of the defrost heater based on the estimated amount of frost formed on the evaporator to perform the defrost operation.

19. The refrigerator according to claim 13, further comprising:

a defrost heater to defrost the evaporator; and a memory storing an output and operation time of the defrost heater based on the amount of frost, the controller reading the output and operation time of the defrost heater based on the estimated amount of frost from the memory to perform the defrost operation.

20. A refrigerator, comprising:

a storage chamber;

an evaporator to cool the storage chamber;

a humidity sensor sensing absolute humidity in the storage chamber;

a door opening and closing the storage chamber;

a door opening and closing sensor sensing the opening and closing of the door; and a controller sensing absolute humidity in the storage chamber immediately before and after the opening and closing of the door, determining an estimated amount of frost formed on the evaporator using the sensed absolute humidity, and controlling a defrost operation based on the estimated amount of frost.

21. The refrigerator according to claim 20, wherein the controller determines a change amount of absolute humidity at the opening the door after the closing of the door from the absolute humidity at the closing the door and determines the estimated amount of frost formed on the evaporator using an integrated value of change amounts of absolute humidity.

22. The refrigerator according to claim 20, wherein the controller reads an amount of frost corresponding to an integrated value of change amounts of absolute humidity from a memory or calculates an amount of frost corresponding to the integrated value of the change amounts of absolute humidity, to determine the estimated amount of frost.

23. The refrigerator according to claim 20, further comprising:

a defrost heater to defrost the evaporator, the controller deciding an operation time of the defrost heater based on the estimated amount of frost to perform the defrost operation.

24. The refrigerator according to claim 20, further comprising:

a defrost heater to defrost the evaporator; and a memory storing an output and operation time of the defrost heater based on the estimated amount of frost, the controller reading an output and operation time of the defrost heater based on the estimated amount of frost from the memory to perform the defrost operation.

25. A defrost control method for a refrigerator having a storage chamber, a door opening and closing the storage chamber, and an evaporator, comprising:

sensing a first absolute humidity in the storage chamber after the door is closed;

sensing a second absolute humidity in the storage chamber after the door is opened, following the door being closed;

calculating a change amount of absolute humidity from the first and second absolute humidities;

calculating an estimated amount of frost from the calculated change amount of absolute humidity;

determining whether to perform a defrost operation based on the estimated amount of frost; and controlling the refrigerator based on the determination.

* * * * *